US006193001B1

(12) United States Patent
Eyre et al.

(10) Patent No.: US 6,193,001 B1
(45) Date of Patent: Feb. 27, 2001

(54) METHOD FOR FORMING A NON-UNIFORM INTERFACE ADJACENT ULTRA HARD MATERIAL

(75) Inventors: Ronald K. Eyre, Orem; Madapusi K. Keshavan, Sandy, both of UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/047,801

(22) Filed: Mar. 25, 1998

(51) Int. Cl.[7] ..... E21B 10/46

(52) U.S. Cl. ..... 175/432; 76/108.2; 76/DIG. 11; 76/DIG. 12; 175/428; 175/434

(58) Field of Search ..... 76/108.2, DIG. 11, 76/DIG. 12; 175/434, 428, 430, 432, 433; 51/293

(56) References Cited

U.S. PATENT DOCUMENTS

| | | | | |
|---|---|---|---|---|
| 4,604,106 | | 8/1986 | Hall et al. | 51/293 |
| 4,610,320 | | 9/1986 | Beakley | 175/409 |
| 4,629,373 | | 12/1986 | Hall | 407/118 |
| 4,764,434 | | 8/1988 | Aronsson et al. | 428/565 |
| 4,954,139 | | 9/1990 | Cerutti | 51/293 |
| 5,011,515 | | 4/1991 | Frushour | 51/307 |
| 5,037,451 | | 8/1991 | Burnand et al. | 51/293 |
| 5,135,061 | * | 8/1992 | Newton, Jr. | 175/428 |
| 5,469,927 | | 11/1995 | Griffin | 175/432 |
| 5,598,750 | * | 2/1997 | Griffin et al. | 76/108.2 |
| 5,662,720 | | 9/1997 | O'Tighearnaigh | 51/295 |
| 5,669,271 | | 9/1997 | Griffin et al. | 76/108.2 |

FOREIGN PATENT DOCUMENTS

| | | | |
|---|---|---|---|
| 2 282 833 | | 4/1995 | (GB) . |
| 2331538 | * | 5/1999 | (GB) . |

* cited by examiner

*Primary Examiner*—David Bagnell
*Assistant Examiner*—Sunil Singh
(74) *Attorney, Agent, or Firm*—Christie, Parker & Hale, LLP

(57) ABSTRACT

A non-uniform interface is formed between a polycrystalline ultra hard material layer and a cemented tungsten carbide substrate, or a polycrystalline ultra hard material layer and a transition layer, or a transition layer and a substrate of a cutting element. A first sheet made from an intermediate material is formed and embossed on one face forming a non-uniform pattern raised in relief on the face. The embossed sheet is placed on a face of a presintered substrate. An ultra hard material sheet is formed and embossed, forming a non-uniform face complementary to the non-uniform face on the sheet of intermediate material. The ultra hard material sheet is placed over the intermediate material sheet so that the complementary faces are adjacent to each other. The assembly of substrate and sheets is sintered in a HPHT process. The sintering process causes the first sheet to become integral with the substrate and results in a substrate having a non-uniform cutting face onto which is bonded a polycrystalline ultra hard material layer. Embossed transition material sheets may be employed between the ultra hard material sheet and the first sheet to form transition layers with uniform or non-uniform interfaces.

52 Claims, 8 Drawing Sheets

METHOD FOR FORMING A NON-UNIFORM INTERFACE ADJACENT ULTRA HARD MATERIAL

BACKGROUND OF THE INVENTION

This invention relates to a method for forming cutting elements and specifically to a method for forming cutting( elements having a non-uniform interface adjacent their cutting layers.

Cutting elements, such as shear cutters for rock bits, for example, typically have a body (or substrate) which has a cutting face. A cutting layer (sometimes referred to as a "cutting table") is bonded to the cutting face of the body. The body is generally made from cemented tungsten carbide (sometimes referred to simply as "tungsten carbide" or "carbide"), while the cutting layer is made from a polycrystalline ultra hard material, such as polycrystalline diamond ("PCD") or polycrystalline cubic boron nitride ("PCBN"). Moreover, these cutters may employ transition layers bonded between the substrate and the cutting layer. The transition layers typically have properties which are intermediate between the properties of the substrate and the cutting layer.

To reduce the residual stresses formed on the interface between the substrate and the cutting layer and to enhance the delamination resistance of the cutting layer, irregularities are sometimes incorporated on the cutting face of the substrate, forming a non-uniform interface between the substrate and the cutting layer. When transition layers are incorporated, one or both faces of the transition layers may also be non-uniform.

As used herein, a uniform interface is one that is flat or always curves in the same direction. This can be stated differently as an interface having the first derivative of slope always having the same sign. Thus, for example, a conventional polycrystalline diamond-coated convex insert for a rock bit has a uniform interface since the center of curvature of all portions of the interface is in or through the carbide substrate.

On the other hand, a non-uniform interface is defined as one where the first derivative of slope has changing signal. An example of a non-uniform interface is one that is wavy with alternating peaks and valleys. Other non-uniform interfaces may have dimples, bumps, ridges (straight or curved) or grooves, or other patterns of raised and lowered regions in relief.

There are a few methods currently being used for forming a non-uniform interface between the substrate and the cutting layer, or between a transition layer and the substrate, or between the a transition layer and the cutting layer. One method requires presintering the substrate. Grooves or other irregularities are then milled or EDM-sunk into the cutting face of the presintered substrate. If a transition layer is to be incorporated, the transition layer may be laid in powder form over the grooved cutting face of the substrate. The ultra hard material layer is then laid over the transition layer. The ultra hard material is also typically laid in powder form.

In situations where a non-uniform interface is required between the transition layer and the ultra hard material layer grooves or other irregularities may be pressed on top of the powder transition layer during a presintering process. The ultra hard material is then applied over the presintered transition layer and the entire assembly consisting of the substrate, transition layer and ultra hard material is sintered in a conventional high temperature, high pressure process.

Other methods of forming non-uniform interfaces commonly require that the grooves are formed on the substrate cutting face during the substrate presintering process. Typically the substrate is formed from a powder tungsten carbide material. Grooves are pressed on a portion of the powder substrate that would form the cutting face while the substrate is being presintered.

As can be seen, the methods currently used for forming a cutting element having non-uniform interfaces between the cutting layer and the substrate, or between the cutting layer and a transition layer, or between the substrate and a transition layer may be labor intensive. As such, there is a need for a simpler method of forming a cutting element having a non-uniform interface.

SUMMARY OF THE INVENTION

To form a non-uniform interface between an ultra hard material cutting layer and a substrate, for example, a sheet of material which after the sintering process is the same as the substrate, is embossed on one face for forming the desired non-uniform interface. For illustrative purposes this sheet is referred to herein as the "substrate material sheet." The substrate material sheet is cut and placed on an end of the substrate. A second sheet ultra hard material is formed and is embossed for forming a non-uniform face complementary to the embossed non-uniform face on the substrate layer. The sheet is cut and the two sheets are mated with each other over the substrate. The entire assembly consisting of the substrate, substrate material sheet and ultra hard material sheet are then sintered together, causing the substrate material sheet to become integral with the substrate and the ultra hard material sheet to bond to the resulting substrate for forming a non-uniform interface between the resulting substrate and the ultra hard material.

Similarly, a transition layer may be formed from a sheet material which after the sintering process has properties intermediate to that of the substrate and the ultra hard material layer. The transition sheet may be embossed on one face and/or both faces to form a non-uniform interface with the ultra hard material sheet, and/or the substrate material sheet, respectively. A protective coating, such as tungsten, niobium, silicon, or aluminum oxide, may be placed on top of the ultra hard material layer prior to sintering. The coating may also be in sheet form. The coating protects the polycrystalline ultra hard material layer.

Multiple ultra hard material sheets may be used to form separate polycrystalline ultra hard material layers and each sheet may be of the same type of ultra hard material, or may be a different type of ultra hard material such as diamond or cubic boron nitride, or may be of the same type of ultra hard material but have a different ultra hard material particle size. Similarly, one or multiple sheets of a transition material may be employed to form one or more transition layers. These sheets will also be embossed as necessary so that they mate with their adjacent sheets on the substrate.

DETAILED DESCRIPTION

Figure 1A:
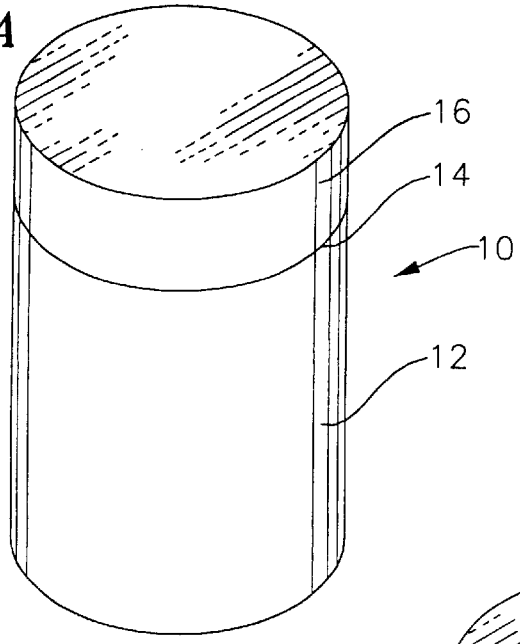
FIG. 1A is a perspective view of a shear cutter.
Figure 1B:
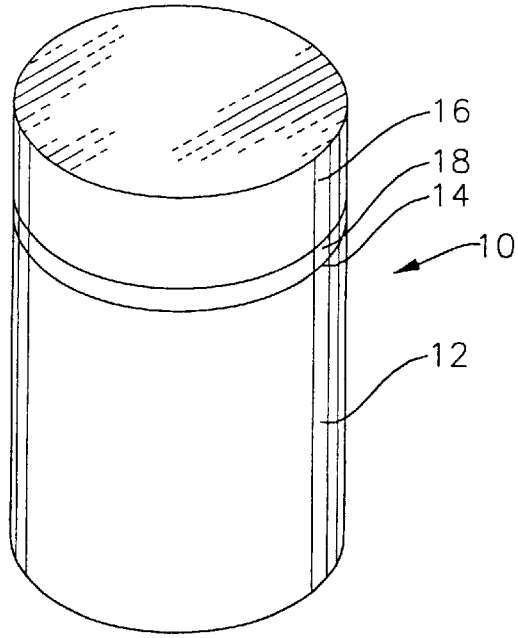
FIG. 1B is a perspective view of a shear cutter having a transition layer.
Figure 2:
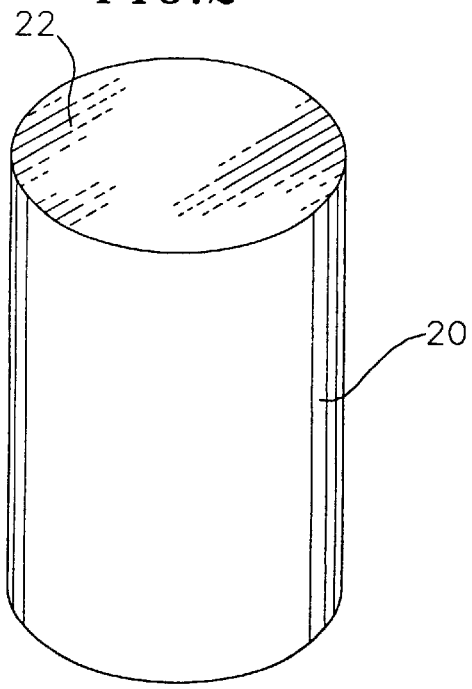
FIG. 2 is a perspective view of a shear cutter body.

For illustrative purposes, this invention will be described in terms of a rock bit shear cutter 10 having a cylindrical body 12 (FIG. 1A). However, as it will be apparent to one skilled in the art, the present invention can be used to form other types of cutting elements. The body 12 of a shear cutter is typically made from cemented tungsten carbide. An end face of the body forms a cutting face 14. An ultra hard material layer 16 such as PCD or PCBN is bonded on the cutting face forming a cutting layer or cutting face. A transition layer 18 or multiple transition layers having properties which preferably are intermediate between the substrate and the cutting layer may also be incorporated between the cutting face and the cutting layer (FIG. 1B). A transition layer may for example be a layer of tungsten carbide, PCD or PCBN having varying particle grain sizes or may be formed from a combination these materials.

Figure 3:
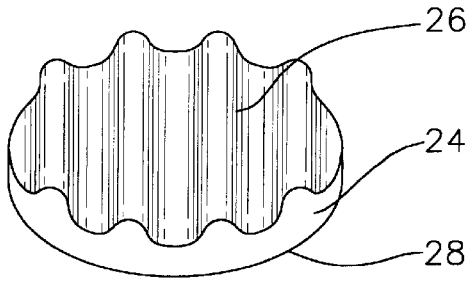
FIG. 3 is a perspective view of a tungsten carbide sheet embossed to form a non-uniform face.

In a first embodiment, a presintered substrate 20 having an end face 22 is formed from a tungsten carbide material. A sheet material 24 having the properties of the substrate after sintering (referred to herein as the "substrate material sheet") is embossed so as to form a non-uniform surface on one of its faces 26 (FIG. 3). The face 28 opposite the embossed face remains flat. This substrate material sheet is cut to an appropriate size for mating to the end face 22 of the substrate. This sheet can be cut and embossed simultaneously.

As used herein, embossing refers to forming a surface of the sheet material to have a design in raised relief. The design may be symmetrical or asymmetrical and have almost any desired configuration. Typically, embossing is obtained by pressing or coining with a steel die or the like, although if many repetitive designs are to be used, a die roller may be used. Moreover, as used herein, the term "sheet" should be construed to include beyond its regular meaning a strip a ribbon and the like as well as a material form that may be as thick as it is wide and/or long. The term should also be construed to include within its meaning any material form comprising a plurality of particles that are bound together. The particles may be loosely or firmly bound together. For example, the particles may be very loosely bound together such that they would prevent one from lifting the "sheet" by itself without the sheet breaking apart. Moreover, the term "sheet" as used herein should not be limited to a material form having flat and/or parallel surfaces. A "sheet" as used herein may, for example, have non-uniform surfaces or even opposite surfaces that are not parallel to each other.

Figure 4:
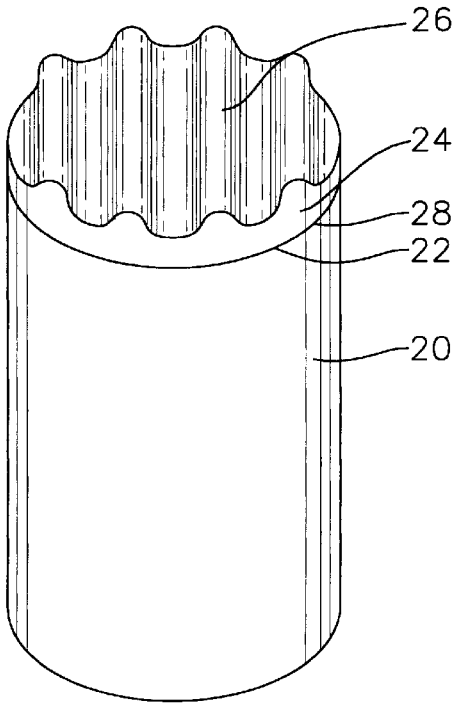
FIG. 4 is a perspective view of a shear cutter carbide body on which is placed an embossed carbide sheet.
Figure 5:
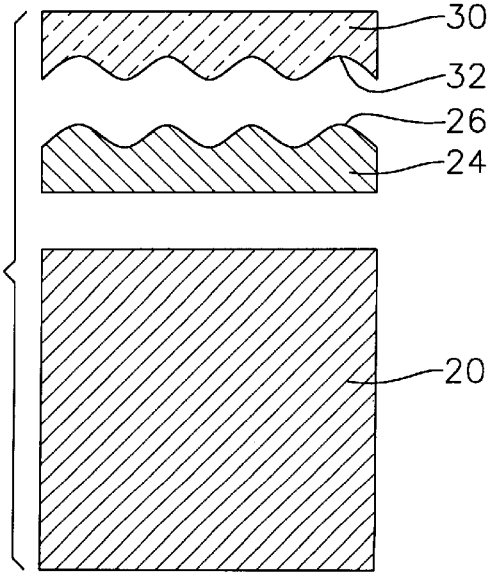
FIG. 5 is a cross-sectional exploded view of a shear cutter formed according to the present invention.

The cut sheet is placed with its flat face on the end face 22 of the presintered substrate 20 (FIG. 4). A sheet 30 of ultra hard material is then cut and embossed on one face 32 forming a non-uniform face complementary to the non-uniform face formed on the substrate material sheet 24 (FIG. 5). The ultra hard material sheet layer is also preferably cut and embossed simultaneously.

The ultra hard material sheet if formed by commingling ultra hard material particles, such a diamond or cubic boron nitride particles, and binder. For example, the sheet may be formed by commingling powderous ultra hard material with a binder such as a wax family binder, e.g., paraffin, polycarbonate, or polyethylene. In a preferred embodiment, a high shear compaction ultra hard material sheet is used. However ultra hard material sheets formed by other methods as for example, tapecasting, doctor blade forming or roll forming can also be used. When a high shear compaction sheet is used, it is preferable that it have rounded particles since layers formed from sheets of high shear compaction ultra hard material having rounded particles have been found to have increased abrasion and impact resistance.

The cut sheet of ultra hard material is placed over the substrate material sheet such that the non-uniform embossed faces of the two layers 32, 26 which are complementary to each other interface with each other. The assembly consisting of the substrate with the two embossed layers is then sintered in a high pressure, high temperature (HPHT) press, forming a cutter with a polycrystalline ultra hard material layer. The sintering process causes the substrate material sheet and the ultra hard material sheet to bond completely to each other and to the substrate body. The bond line between the substrate material sheet and the substrate is non-differentiable or nearly so. In essence, the substrate material sheet becomes integral with the substrate and a non-uniform interface is formed between the polycrystalline ultra hard material layer and the resulting substrate.

It should be noted that the substrate material sheet may be formed by the same methods used to form the ultra hard material sheet. Of course, instead of ultra hard material particles, tungsten carbide particles are commingled with a binder.

In a further embodiment (not shown), instead of placing an ultra hard material embossed sheet over the substrate material sheet, the ultra hard material may be placed in powder form over the non-uniform face of the substrate material sheet and then sintered together using conventional HPHT techniques.

Figure 6A:
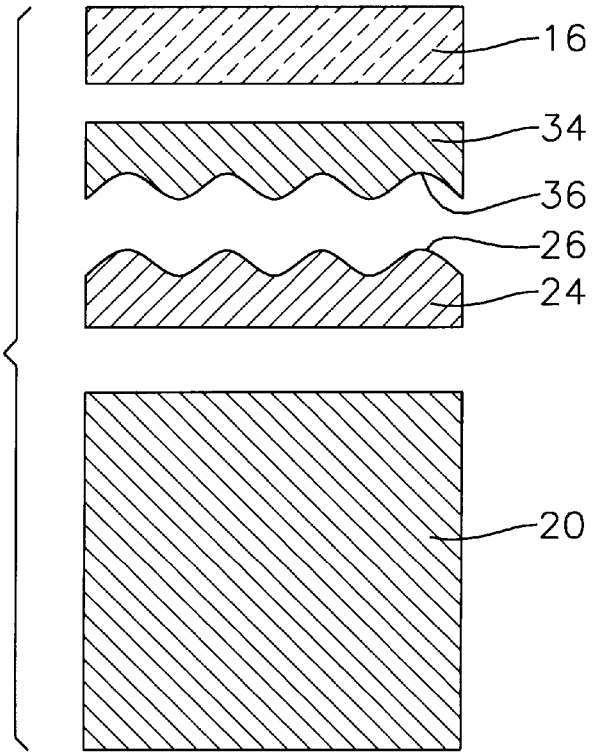
FIGS. 6A, 6B and 6C are exploded views of shear cutters formed according to the present invention having transition layers.

In yet further embodiments, a sheet 34 of transition material having properties after processing intermediate between the tungsten carbide substrate and the ultra hard material layer is also employed (FIG. 6A). The intermediate properties, for example, may include an intermediate coefficient of thermal expansion. As discussed above, the transition material sheet may include tungsten carbide, diamond, cubic boron nitride particles of varying sizes and any combination thereof. The transition material sheet may be formed by the same methods as those used to form the ultra hard material sheet. In other embodiments, the transition material may not have properties after precessing intermediate between the tungsten carbide substrate and the ultra hard material layer. For example, the transition material may be an ultra hard material itself.

Figure 6B:
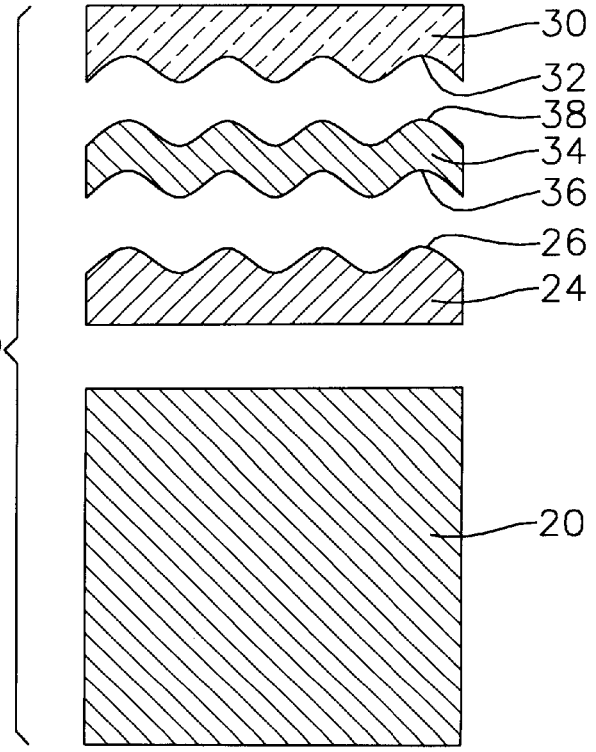
Figure 13:
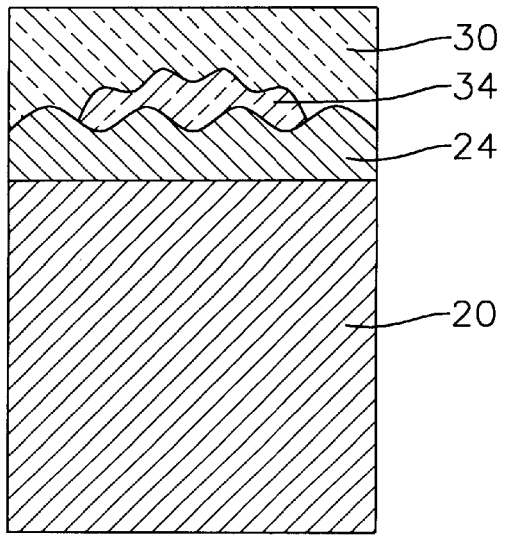
FIG. 13 is a cross-sectional view of a shear cutter of an embodiment of the present invention having one layer of material encapsulated between two other layers.

The transition material sheet is cut and embossed on one face 36 forming, a surface complementairy to the embossed face 26 of the substrate material sheet (FIG. 6A). Alternatively, the transition material sheet 34 may be embossed on both faces 36, 38 (FIGS. 6B and 13). In the latter case, the ultra hard material sheet 30 is cut and embossed such that its embossed face 32 is complementary to the upper embossed face 38 of the transition material sheet. The carbide, transition, and ultra hard material sheets are then positioned over the presintered substrate and the entire assembly is sintered together for forming a cutting, element having a transition layer interposed between the substrate and the ultra hard material layer.

Instead of a single transition material sheet, multiple transition material sheets may be used. Each transition material sheet has faces complementary to the corresponding faces of the other sheets or substrate with which they will interface.

Figure 6C:
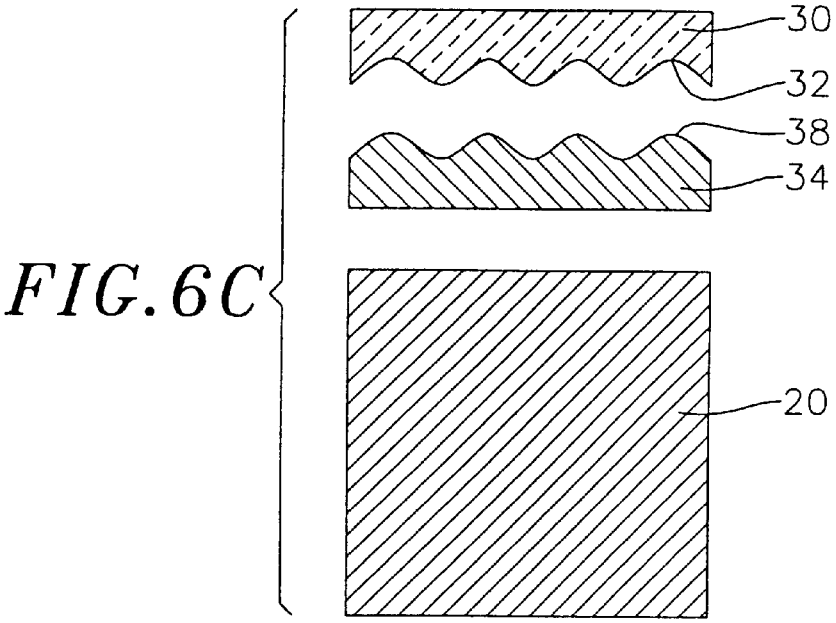

In yet a further alternate embodiment as shown in FIG. 6C, a substrate material sheet is not used. Rather, a sheet made from a transition material is embossed on one face 38 and placed over the substrate end 22. An ultra hard material sheet 30 is then cut and embossed, forming a face 32 that is complementary to the embossed non-uniform face 38 of the transition material sheet. The ultra hard material sheet is then placed on top of the transition sheet such that the embossed face of the ultra hard material sheet is mated with the embossed face of the transition material sheet. The entire assembly is then sintered for forming a cutting element having a transition layer having, a non-uniform interface with the ultra hard material layer. As will be apparent to one skilled in the art, a single or multiple transition sheets may be employed for forming transition layers wherein each sheet may have one face, both faces, or no faces embossed.

Figure 7:
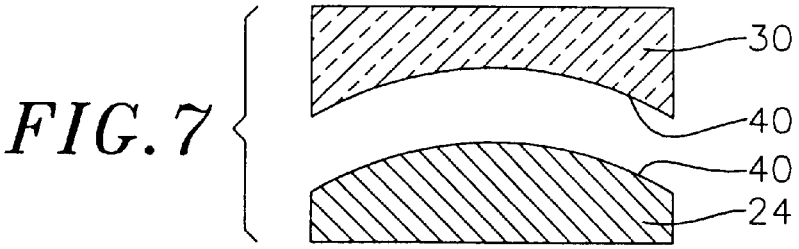
FIG. 7 is an exploded cross-sectional view depicting exemplary embossed non-uniform faces formed on an ultra hard material sheet and a transition material sheet.
Figure 8:
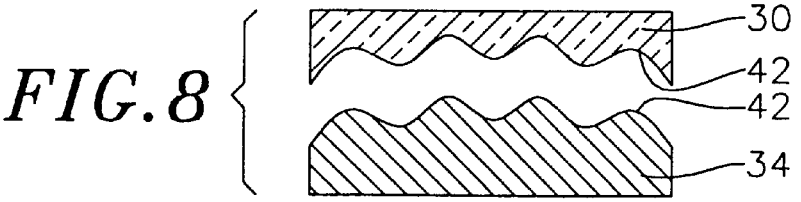
FIG. 8 is an exploded cross-sectional view depicting exemplary embossed non-uniform faces formed on an ultra hard material sheet and substrate material sheet layer.
Figure 9A:
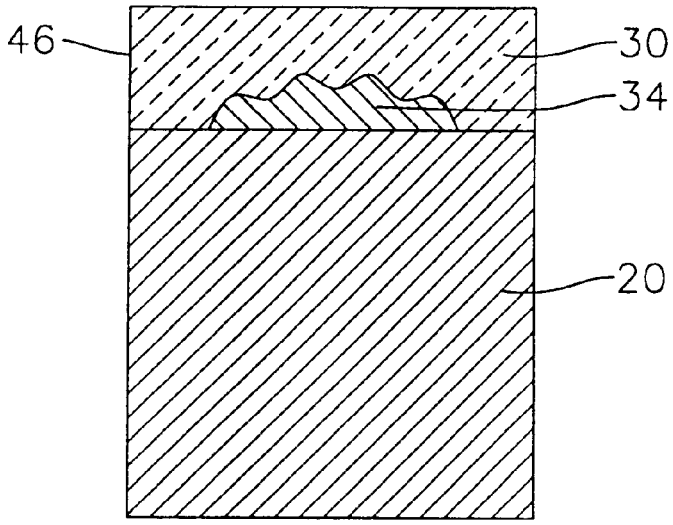
FIGS. 9A and 9B are cross-sectional side views of shear cutters incorporating embossed transition layers and complementary ultra hard material layers formed from sheets of the respective materials.
Figure 9B:
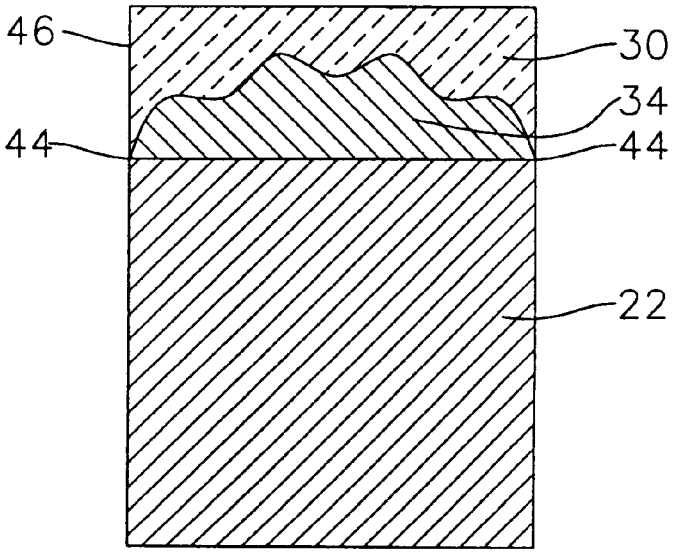
Figure 12:
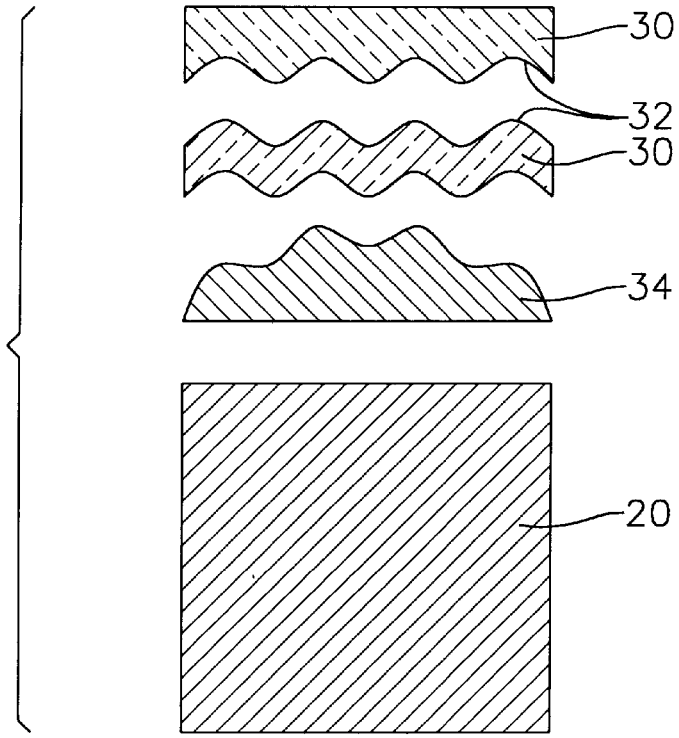
FIG. 12 is an exploded cross-sectional view depicting an exemplary embodiment shear cutter comprising two ultra hard material layers and a transition layer encapsulated by one of the ultra hard material layers.

The substrate material sheet, the transition material sheet 34, and the ultra hard material sheet 30 may be embossed with raised designs to form various cross-sectional geometries. For example, the embossed non-uniform faces may have a continuous curvature 40 (FIG. 7), or may comprise multiple ridges and grooves or other irregularities 42 (FIG. 8). These ridges or grooves may be annular or linear or even wiggly. Moreover, the embossed transition material sheet may be cut to form a transition layer 34 that is smaller than the ultra hard material layer 30 ) (FIGS. 9A, 12 and 13) or may form a transition layer which tapers to an edge 44 at the cutting element periphery 46 (FIG. 9B) so as to allow for maximum ultra hard material layer thickness at the circumference of the cutting element. An increase in the thickness of the ultra hard material layer results in an increase in the impact and wear resistance of the cutting clement. An increase in the ultra hard layer thickness at the circumference of a shear cutter is desirable since shear cutters are mounted on a bit at a rake angle and contact the earth formation along their circumferential edge. Moreover, instead of one, multiple ultra hard material layers 30 may be formed over the transition layer 34, as shown for example in FIG. 12. The ultra hard material layers may interface with each other with their complementary non-uniform faces 32.

Figure 10A:
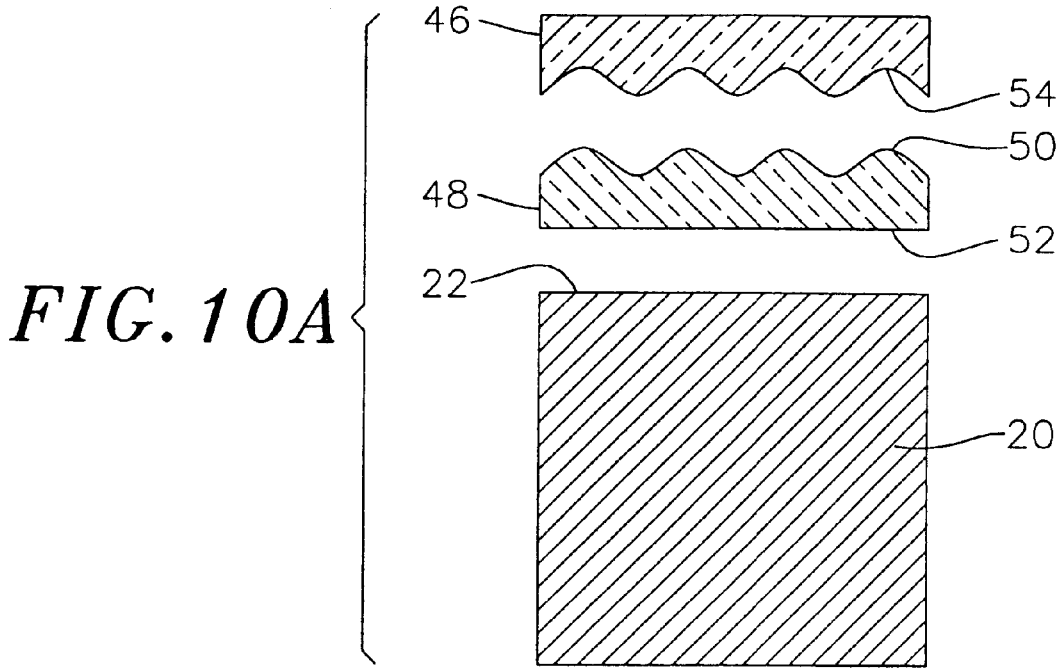
FIGS. 10A and 10B are cross-sectional exploded views of shear cutters employing two ultra hard material embossed sheets for forming polycrystalline ultra hard material layers.

As will be apparent to one skilled in the art, with any of the above referenced embodiments, multiple sheets of embossed ultra hard material may be employed, each forming a separate ultra hard material layer. The ultra hard material layers may contain different grades of ultra hard material or may even be of different types of ultra hard material, as for example, diamond and cubic boron nitride. Different particle sizes of the same ultra hard material may be applied in separate embossed sheets. For example, the cutting element may be formed using two ultra hard material sheets 46, 48, one on top of the other, wherein each sheet contains a different grade of ultra hard material. With this embodiment, a sheet of a first grade diamond material is embossed on one side to form a non-uniform surface 50 (FIG. 10A). The face 52 opposite the embossed face remains flat. The sheet is cut to appropriate size. The flat face is placed on the cutting face 22 of the tungsten carbide substrate. A sheet 46 made from a second grade of ultra grade material is cut to approximate size and embossed, forming a non-uniform face 54 that is complementary to the non-uniform face 50 of the first cut sheet. The second cut sheet is placed over the first sheet such that the complementary non-uniform faces of the two sheets interface with each other. The whole assembly is then sintered in a HPHT process for forming a polycrystalline layer of ultra hard material.

Figure 10B:
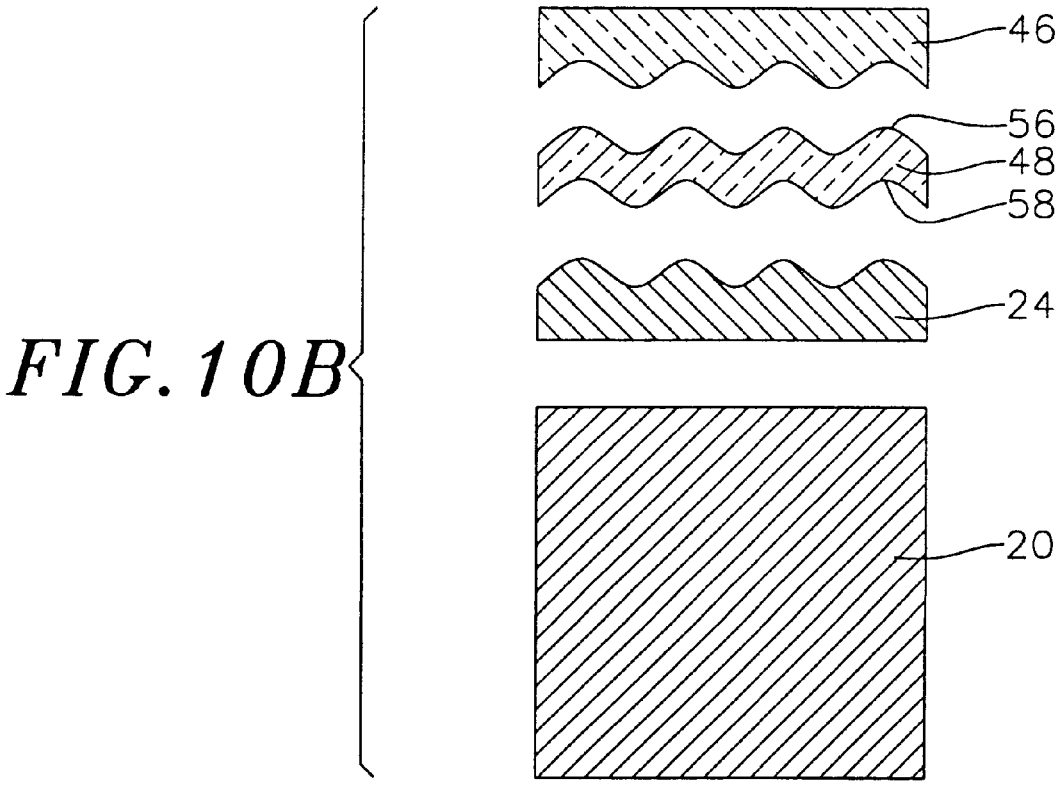

With this embodiment the first grade ultra hard material sheet 48 may be embossed on both of its faces 56, 58 and interface with a substrate material sheet 24 that is positioned on top of the presintered substrate so as to form a non-uniform interface between the resulting substrate and the first ultra hard material layer (FIG. 10B). Alternatively, the ultra hard material sheet 48 may be positioned on top of a transition material sheet 34.

Embossing is used in the present invention to form a non-uniform face on the material sheets by creating a pattern of relief. However, with any of the aforementioned embodiments, the non-uniform faces on the material sheets may be formed by processes other than embossing such as stamping or coining. The embossing or stamping may occur by using a roller which is rolled along the length of the sheet to emboss or stamp the desired non-uniform pattern multiple times along the length of the sheet. To form the desired pattern the roller will have protrusions extending from its surface that are complementary to the pattern. The sheet may then be cut in sections whereby each section comprises a pattern. The section is then placed on the presintered substrate for forming the desired layer. Moreover, the roller may also simultaneously cut the sheet to the desired shape as it embosses it or stamps it so as to form the individual sheet sections containing the desired pattern.

Figure 10C:
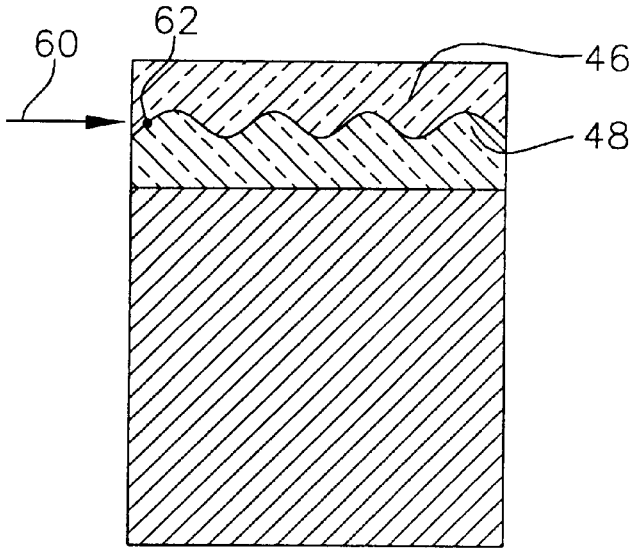
FIG. 10C is a cross-sectional view of a shear cutter employing two ultra hard material layers.

With any of the above described embodiments, crack growth that travels chordwise 60 along the cutting layer is arrested once it grows horizontally through and across the layer in which it is initially formed and reaches a different grade or a different type of layer, as for example, when it reaches point 62 as shown in FIG. 10C.

Figure 11:
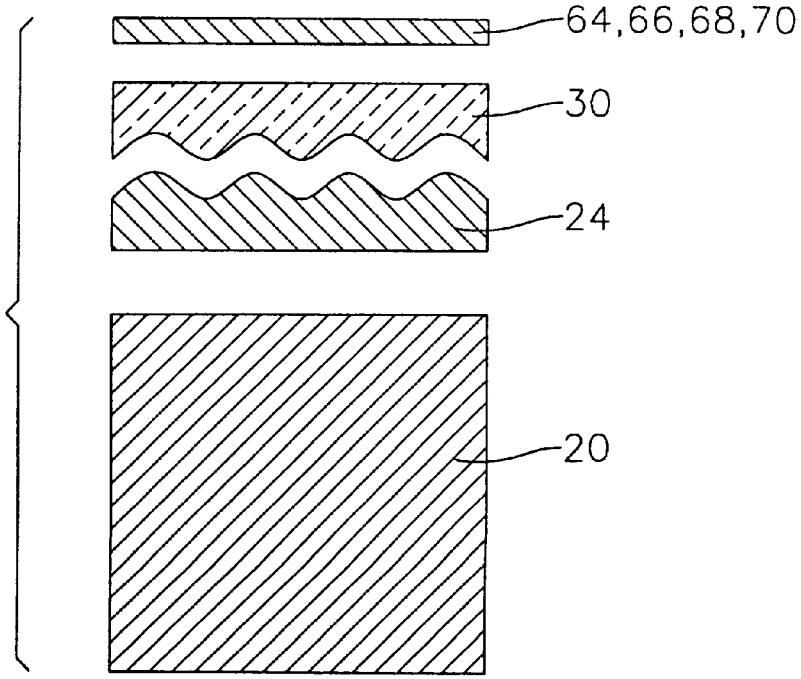
FIG. 11 is a partial cross-sectional exploded view of a shear cutter employing a protective coating, over the ultra hard material layer.

With all of the above described embodiments, a coating 64 may be applied over the ultra hard material layer 30 to improve the thermal stability and to change the residual stresses in the ultra hard material layer, and to protect the cobalt in the ultra hard material layer from the corrosive environment during drilling (FIG. 11). In one embodiment, a tungsten coating in foil form 66 is placed over the ultra hard material sheet layer prior to sintering. Once the cutting element is sintered, the tungsten foil 66 forms into a tungsten carbide coating.

In other embodiments, instead of a tungsten coating, a tape 68 of niobium or a wafer 70 of silicon is placed over the ultra hard material 30. If niobium is used, the a coating of niobium carbide is formed over the ultra hard material layer after the sintering process is completed. If silicon is used, a coating of silicon carbide is formed after sintering. Alternatively, a powder of aluminum oxide may be placed over the ultra hard material layer to form a coating of aluminum oxide. The thickness of these coatings are preferably between 5 and 10 microns.

What is claimed is:

1. A method for forming a non-uniform interface adjacent to a layer of polycrystalline ultra hard material comprising the steps of:

preforming a first sheet of intermediate material having a first non-uniform face having the shape of a desired interface;

preforming a sheet of ultra hard material having a face complementary to the face on the intermediate material sheet;

placing the preformed sheet of intermediate material on a substrate and the preformed sheet of ultra hard material on the intermediate material sheet with the complementary faces adjacent to each other; and processing the resulting assembly of substrate and sheets at sufficient temperature and pressure for forming the layer of polycrystalline ultra hard material from the ultra hard material sheet.

2. A method as recited in claim 1 wherein after processing the intermediate material is the same as the substrate.

3. A method as recited in claim 1 wherein the intermediate material produces properties after processing between the properties of the polycrystalline ultra hard material and the substrate material.

4. A method as recited in claim 1 wherein the step of preforming a sheet of intermediate material comprises the step of embossing the non-uniform face on the sheet.

5. A method as recited in claim 1 wherein the step of preforming a sheet of intermediate material comprises forming the non-uniform face by the step selected from the group of steps consisting of coining and stamping.

6. A method as recited in claim 1 wherein the step of preforming a sheet of ultra hard material comprises the step of embossing the face of the sheet of ultra hard material which is complementary to the non-uniform face of the sheet of intermediate material.

7. A method as recited in claim 1 wherein the step of preforming a sheet of ultra hard material comprises forming the face complementary to the face of the intermediate material sheet by the step selected from the group of steps consisting of coining and stamping.

8. A method as recited in claim 1 wherein the step of preforming a sheet of ultra hard material comprises the step of preforming a high shear compaction sheet of ultra hard material.

9. A method as recited in claim 1 wherein the step of preforming a sheet of ultra hard material having a non-uniform face comprises the step of preforming a sheet of ultra hard material having a non-uniform face complementary to and for encapsulating the non-uniform face of the intermediate material sheet, and wherein the step of processing comprises forming the polycrystalline ultra hard material layer encapsulating the intermediate material.

10. A method as recited in claim 1 further comprising the steps of:

forming a second non-uniform face opposite the first non-uniform face on the first intermediate material sheet, preforming a second sheet of intermediate material having a non-uniform face complementary to the second face of the first sheet; and placing the second intermediate material sheet between the substrate and the first intermediate material sheet with the non-uniform face of the second intermediate material sheet adjacent the complementary second non-uniform face on the first intermediate material sheet.

11. A method as recited in claim 10 wherein after processing the second intermediate material is the same as the substrate.

12. A method as recited in claim 10 wherein the second intermediate material produces properties between the properties of the polycrystalline ultra hard material and the substrate material.

13. A method as recited in claim 1 further comprising the step of placing a coating selected from the group consisting of tungsten, niobium, silicon and aluminum oxide over the ultra hard material sheet.

14. A method for forming a non-uniform interface adjacent to a layer of polycrystalline ultra hard material comprising the steps of:

forming a first sheet of ultra hard material having a non-uniform face having the shape of a desired interface;

preforming a second sheet of ultra hard material having a first face complementary to the non-uniform face on the first sheet;

placing the second sheet on a substrate and the first sheet on the second sheet with the complementary faces adjacent to each other; and processing the resulting assembly of substrate and sheets at sufficient temperature and pressure for forming the layer of polycrystalline ultra hard material from the sheets.

15. A method as recited in claim 14 wherein the step of preforming a second sheet of ultra hard material, comprises the step of preforming a second sheet of ultra hard material having an ultra hard material grain size different from the ultra hard material grain size of the first sheet.

16. A method as recited in claim 14 wherein the step of preforming a second sheet of ultra hard material, comprises the step of preforming a second sheet of an ultra hard material type that is different from the ultra hard material of the first sheet.

17. A method as recited in claim 14 wherein the step of preforming a first sheet of ultra hard material comprises the step of embossing the non-uniform face on the first sheet.

18. A method as recited in claim 14 wherein the step of preforming a first sheet of ultra hard material comprises forming the non-uniform face of the first sheet of ultra hard material by the step selected from the group of steps consisting of coining and stamping.

19. A method as recited in claim 14 wherein the step of preforming a second sheet of ultra hard material comprises the step of embossing the non-uniform face on the second sheet.

20. A method as recited in claim 14 wherein the step of preforming a second sheet of ultra hard material comprises forming the non-uniform face of the second sheet of ultra hard material complementary to the non-uniform face on the first sheet of ultra hard material by the step selected from the group of steps consisting of coining and stamping.

21. A method as recited in claim 14 wherein the step of preforming a first sheet of ultra hard material having a non-uniform face comprises the step of preforming the first sheet of ultra hard material having a non-uniform face complementary to and for encapsulating the non-uniform face on the second sheet of ultra hard material.

22. A method as recited in claim 14 further comprising the steps of:

forming, a second non-uniform face on the second sheet opposite the first non-uniform face formed on that sheet;

preforming a sheet of intermediate material having a non-uniform face complementary to the second non-uniform face on the second sheet of ultra hard material; and placing the intermediate material sheet between the substrate and the second sheet of ultra hard material with the non-uniform face of the intermediate sheet adjacent to the complementary second non-uniform face on the second ultra hard material sheet.

23. A method as recited in claim 22 wherein after processing the intermediate material is the same as the substrate material.

24. A method as recited in claim 22 wherein after processing the intermediate material produces properties after processing between the properties of the polycrystalline ultra hard material and the substrate material.

25. A method as recited in claim 22 wherein the step of preforming a sheet of intermediate material comprises the step of embossing the non-uniform face on the sheet of intermediate material.

26. A method as recited in claim 22 wherein the step of forming a sheet of intermediate material comprises forming the non-uniform face of the intermediate sheet by the step selected from the group of steps consisting of coining and stamping.

27. A method as recited in claim 22 wherein the step of forming a second non-uniform face on the second sheet of ultra hard material comprises the step of forming the second non-uniform face complementary to and for encapsulating the non-uniform face formed on the intermediate material sheet, and wherein the step of processing comprises forming the polycrystalline ultra hard material encapsulating the intermediate material.

28. A method as recited in claim 14 further comprising the step of placing a coating selected from the group consisting of tungsten, niobium, silicon and aluminum oxide over the first sheet ultra hard material sheet.

29. A method for forming a non-uniform interface adjacent to a layer of hard material comprising the steps of:

forming a sheet of material having a non-uniform face having the shape of a desired interface;

placing the sheet of material on a substrate, exposing the non-uniform face; and placing a harder particulate material on the non-uniform face; and processing the resulting assembly of substrate, sheet and harder material at sufficient temperature and pressure for forming the layer of hard material, wherein after processing the sheet of material is the same as the substrate.

30. A method as recited in claim 29 wherein the step of placing a harder particulate material comprises the step of placing an ultra hard particulate material on the non-uniform face and wherein the step of processing comprises the step of processing the resulting assembly of substrate, sheet and ultra hard material at sufficient temperature and pressure for forming a layer of polycrystalline ultra hard material.

31. A method as recited in claim 29 wherein the step of forming a sheet of material comprises the step of embossing the non-uniform face on the sheet of intermediate material.

32. A method as recited in claim 29 wherein the step of forming a sheet of material comprises forming the non-uniform face of the sheet by the step selected from the group of steps consisting of coining and stamping.

33. A method as recited in claim 29 wherein the step of placing a harder particulate material comprises the step of placing the harder particulate material on the non-uniform face, encapsulating the sheet.

34. A method for forming a non-uniform interface adjacent to a layer of hard material comprising the steps of:

forming a substrate having an end face having a periphery;

forming a sheet of material having a non-uniform face having the shape of a desired interface and having a peripheral edge;

placing the sheet of material on the substrate, exposing the non-uniform face, wherein the peripheral edge of the sheet does not extend to the periphery of the substrate end face; and placing a harder particulate material over the sheet of material encapsulating the sheet of material; and processing the resulting assembly of substrate, sheet and harder material at sufficient temperature and pressure for forming the layer of hard material encapsulating the sheet of material.

35. A method as recited in claim 34 wherein after processing the sheet of material is the same as the substrate.

36. A method as recited in claim 34 wherein the sheet of material produces properties after processing between the properties of the hard material layer and the substrate.

37. A method for forming a non-uniform interface adjacent to a layer of hard material comprising the steps of:

forming a first sheet of material having a non-uniform first face having the shape of a desired interface and a non-uniform second face opposite the non-uniform first face;

forming a second sheet of material having a non-uniform first face opposite a second face, wherein the first sheet second face is complementary to the second sheet first face;

placing the second sheet of material on a substrate, exposing the second sheet first face;

placing the first sheet on the first face of the second sheet, exposing the first sheet non-uniform first face; and placing a harder particulate material on the non-uniform first face of the first sheet; and processing the resulting assembly of substrate, first sheet, second sheet and harder material at sufficient temperature and pressure for forming the layer of hard material.

38. A method as recited in claim 37 wherein the first sheet of material produces properties after processing between the properties of the hard material layer and the substrate.

39. A method as recited in claim 37 wherein the step of placing a harder particulate material comprises the step of placing the harder particulate material over the first sheet encapsulating the first sheet.

40. A method for forming a non-uniform interface adjacent to a layer of hard material comprising the steps of:

forming a sheet of material;

cutting a sheet portion from said sheet;

embossing a non-uniform face having the shape of a desired interface on said sheet portion, wherein the embossing step occurs simultaneously with cutting step;

placing the sheet portion on a substrate, exposing the non-uniform face; and placing a harder particulate material on the non-uniform face; and processing the resulting assembly of substrate, sheet portion and harder material at sufficient temperature and pressure for forming the layer of hard material.

41. A method for forming a non-uniform interface adjacent to a layer of polycrystalline ultra hard material comprising the steps of:

forming a first sheet of intermediate material having a first non-uniform face having the shape of a desired interface;

forming a sheet of ultra hard material having a face complementary to the face on the intermediate material sheet, wherein the complementary face is formed by the step selected from the group of steps consisting of coining and stamping;

placing the sheet of intermediate material on a substrate and the sheet of ultra hard material on the intermediate material sheet with the complementary faces adjacent to each other; and processing the resulting assembly of substrate and sheets at sufficient temperature and pressure for forming the layer of polycrystalline ultra hard material from the ultra hard material sheet.

42. A method for forming a non-uniform interface adjacent to a layer of polycrystalline ultra hard material comprising the steps of:

forming a first sheet of intermediate material having a first non-uniform face having the shape of a desired interface and a second non-uniform face opposite the first non-uniform face;

forming a second sheet of intermediate material having a non-uniform face complementary to the second non-uniform face of the first non-uniform sheet;

forming a sheet of ultra hard material having a face complementary to the first non-uniform face on the first intermediate material sheet;

placing the second sheet of intermediate material on a substrate;

placing the first sheet of intermediate material on the second sheet of intermediate material with their complementary faces adjacent to each other;

placing the sheet of ultra hard material on the first sheet of intermediate material with their complementary faces adjacent to each other; and processing the resulting assembly of substrate and sheets at sufficient temperature and pressure for forming the layer of polycrystalline ultra hard material from the ultra hard material sheet.

43. A method as recited in claim 42 wherein after processing the second intermediate material is the same as the substrate.

44. A method as recited in claim 42 wherein the second intermediate material produces properties between the properties of the polycrystalline ultra hard material and the substrate material.

45. A method for forming a non-uniform interface adjacent to a layer of polycrystalline ultra hard material comprising the steps of:

preforming a first sheet of intermediate material having a first non-uniform face having the shape of a desired interface;

preforming a sheet of ultra hard material having a face complementary to the first non-uniform face on the intermediate material sheet;

placing the sheet of intermediate material on a substrate and the sheet of ultra hard material on the intermediate material sheet with the complementary faces adjacent to each other;

placing a coating selected from the group consisting of tungsten, niobium, silicon and aluminum oxide over the ultra hard material sheet; and processing the resulting assembly of substrate and sheets at sufficient temperature and pressure for forming the layer of polycrystalline ultra hard material from the ultra hard material sheet.

46. A method for forming a non-uniform interface adjacent to a layer of polycrystalline ultra hard material comprising the steps of:

forming a first sheet of ultra hard material having a non-uniform face having the shape of a desired interface, wherein the non-uniform face is formed by the step selected from the group of steps consisting of coining and stamping;

forming a second sheet of ultra hard material having a first face complementary to the non-uniform face on the first sheet;

placing the second sheet on a substrate and the first sheet on the second sheet with the complementary faces adjacent to each other;

processing the resulting assembly of substrate and sheets at sufficient temperature and pressure for forming the layer of polycrystalline ultra hard material from the sheets.

47. A method for forming a non-uniform interface adjacent to a layer of polycrystalline ultra hard material comprising the steps of:

forming a first sheet of ultra hard material having a first non-uniform face hating the shape of a desired interface;

forming a second sheet of ultra hard material having a first face complementary to the non-uniform face on the first sheet and a second non-uniform face opposite the first face;

forming a sheet of intermediate material having a non-uniform face complementary to the second non-uniform face on the second sheet of ultra hard material;

placing the sheet of intermediate material on a substrate;

placing the second ultra hard material sheet on the sheet of intermediate material with the non-uniform face of the intermediate sheet adjacent to the complementary second non-uniform face on the second ultra hard material sheet;

placing the first sheet on the second sheet with the complementary faces adjacent to each other; and processing the resulting assembly of substrate and sheets at sufficient temperature and pressure for forming the layer of polycrystalline ultra hard material from the sheets.

48. A method as recited in claim 47 wherein after processing the intermediate material is the same as the substrate material.

49. A method as recited in claim 47 wherein after processing the intermediate material produces properties after processing between the properties of the polycrystalline ultra hard material and the substrate material.

50. A method as recited in claim 47 wherein the step of forming a sheet of intermediate material comprises the step of embossing the non-uniform face on the sheet of intermediate material.

51. A method as recited in claim 47 wherein the step of forming a sheet of intermediate material comprises forming the non-uniform face on the intermediate material sheet by the step selected from the group of steps consisting of coining and stamping.

52. A method as recited in claim 47 wherein the step of forming a second non-uniform face on the second sheet ofultra hard material comprises the step of forming a second non-uniform face complementary to and for encapsulating the non-uniform face formed on the intermediate material sheet, and wherein the step of processing comprises forming the polycrystalline ultra hard material encapsulating the intermediate material.

* * * * *

UNITED STATES PATENT AND TRADEMARK OFFICE

CERTIFICATE OF CORRECTION

PATENT NO. : 6,193,001 B1 
DATED : February 27, 2001
INVENTOR(S) : Ronald K. Eyre and Madapusi K. Keshavan It is certified that error appears in the above-identified patent and that said Letters Patent is hereby corrected as shown below:

Column 8,
Line 24, before “a first sheet” replace “forming” with -- preforming --.

Column 9,
Line 1, after “having” replace “a” with -- the --.
Line 6, after “forming” delete the comma.
Lines 21 and 22, after “properties” delete “after processing”.

Column 12,
Line 28, replace “hating” with -- having --.

Column 13,
Line 3, replace “ofultra” with -- of ultra --.

Signed and Sealed this

Twenty-first Day of January, 2003

JAMES E. ROGAN
*Director of the United States Patent and Trademark Office*